United States Patent [19]

Comfort

[11] Patent Number: 4,584,633

[45] Date of Patent: Apr. 22, 1986

[54] COMBINATION NIGHT LIGHT EYEGLASS HOLDER

[75] Inventor: Richard A. Comfort, West Haven, Conn.

[73] Assignee: Lance W. Comfort, Long Beach, Calif.

[21] Appl. No.: 652,100

[22] Filed: Sep. 19, 1984

[51] Int. Cl.[4] ..... F21V 33/00

[52] U.S. Cl. ..... 362/253; 200/85 R; 362/801; 362/109

[58] Field of Search ..... 362/253, 801, 109, 116, 362/234, 394, 132, 29, 130; 200/85 R

[56] References Cited

U.S. PATENT DOCUMENTS

| | | | |
|---|---|---|---|
| 1,442,896 | 1/1923 | Maier | 362/253 |
| 1,753,488 | 4/1930 | Vesperman | 362/253 |
| 2,185,051 | 12/1939 | Daigle | 362/130 |
| 2,273,353 | 2/1942 | Harris | 362/253 |
| 2,617,910 | 11/1952 | Ilarrazaysegora | 362/253 |
| 2,666,128 | 1/1954 | Crawford | 200/85 R |
| 2,677,043 | 4/1954 | Hawk | 260/85 R |
| 2,745,947 | 5/1956 | Sansous | 362/109 |
| 2,787,070 | 4/1957 | Ipoine | 362/253 |
| 2,800,543 | 7/1957 | Herzog | 200/85 R |
| 2,812,422 | 11/1957 | Proui | 362/253 |
| 2,998,508 | 8/1961 | Bobrick | 362/801 |
| 3,017,497 | 1/1962 | Albright | 362/394 |
| 3,348,006 | 10/1967 | Brand | 200/85 R |
| 4,285,028 | 8/1981 | Sundin | 362/253 |

*Primary Examiner*—Carl Stuart Miller

*Attorney, Agent, or Firm*—Andra M. Finkel

[57] ABSTRACT

The present invention comprises an eyeglass holder which may have a suitable ornamental appearance, a power inlet to the device, and a power outlet such as an AC socket into which may be plugged a reading lamp, bedside radio, etc. The device of the invention further comprises a night light such as a small lamp which is mounted so as to facilitate the location and retrieval of the eyeglasses in the dark. A normally closed switch is located between the power inlet and the power outlet so that the AC current from the inlet is normally available at the power outlet for lighting a reading lamp or the like. When a pair of eyeglasses is placed in the holder, the device plugged into the outlet is turned off. Also, when the eyeglasses are placed in the holder, the switch closes in response thereto to supply power to the night lamp which remains lit so long as the eyeglasses remain in the holder to facilitate retrieval of the glasses in a dark room. When the eyeglasses are removed from the holder, the night lamp is extinguished and the normally closed switches return to their normal states.

11 Claims, 4 Drawing Figures

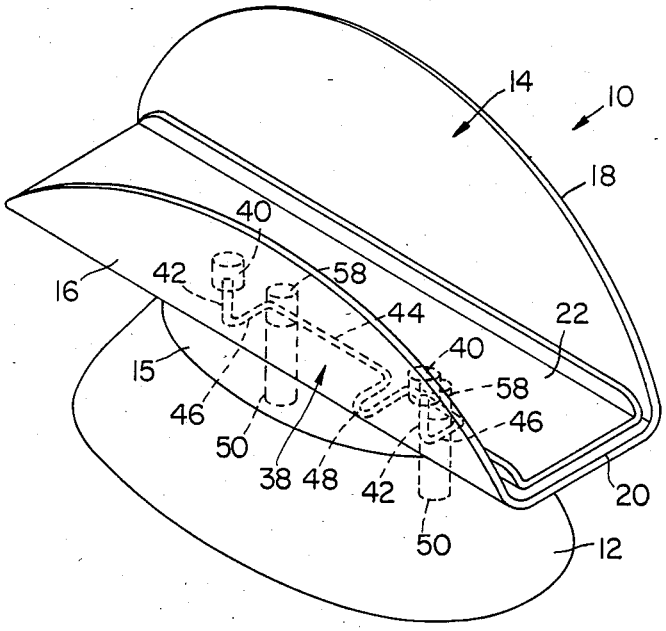
FIG.1
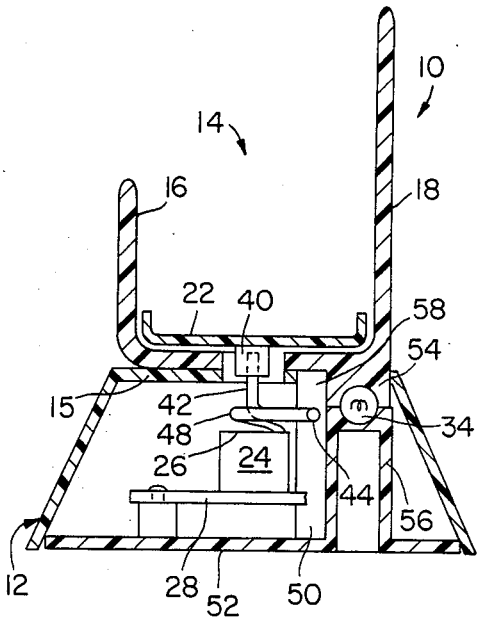
FIG.3
FIG.4
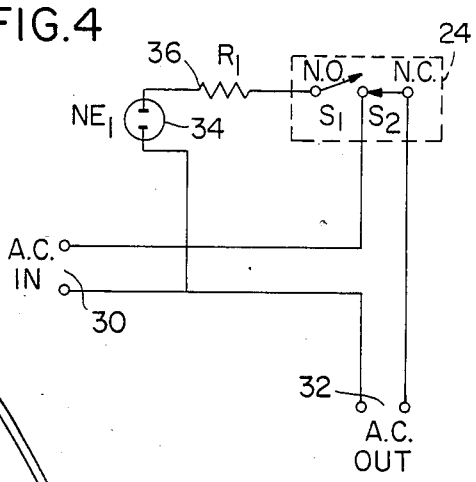
FIG.2
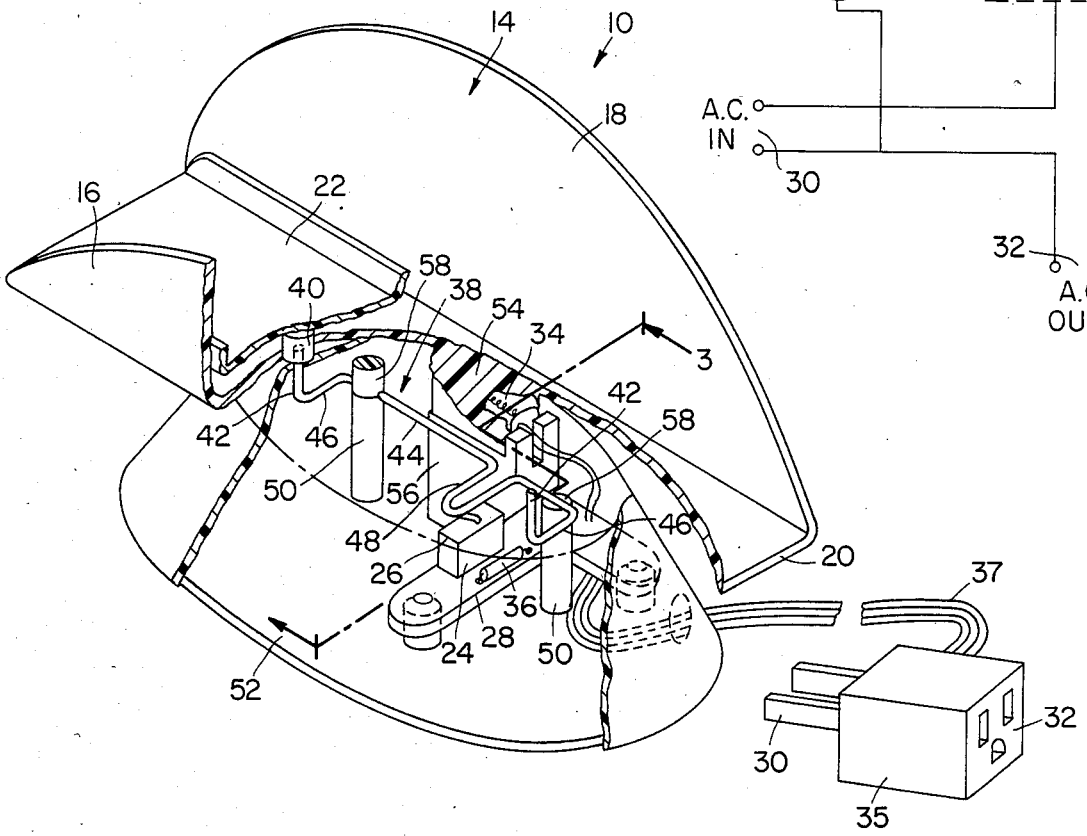

COMBINATION NIGHT LIGHT EYEGLASS HOLDER

BACKGROUND OF THE INVENTION

1. Field of the Invention

The present invention pertains generally to the field of night lights and eyeglass holders for bedside use, and is more particularly directed to an eyeglass holder provided with a night lamp and switch means for cutting off power to a reading lamp while also switching on the night light when a pair of eyeglasses is placed in the holder.

2. Prior Art

Various devices are known wherein use is made of a switch responsive to the presence of a pair of eyeglasses or goggles for controlling power to some device. In particular, applicant is aware of U.S. Pat. Nos. 2,466,355 to Baker and 2,800,543 to Herzog wherein electrical power to a motor driven tool is controlled by a switch which opens in response to the weight of a pair of safety goggles hung therefrom. The switch is used as a safety device such that the power tool cannot be used so long as the safety goggles are suspended from the switch thereby reminding a user to wear the goggles prior to operating the tool.

Yet other patents known to applicant disclose pressure operated switches which control power to a bedroom light, as exemplified by U.S. Pat. Nos. 2,185,051 to Daigle and 2,425,790 to Fletcher. These two patents disclose light switches which respond to the weight of a person occupying a bed and control power to a bedroom light in response thereto.

None of these patents, however, address the problem of controlling a bedroom light in response to a person's removing and placing his or her eyeglasses on a nightstand in preparation to retiring for the night, while also providing means for assisting the person in subsequently retrieving the eyeglasses in a darkened room. Applicant is unaware of any existing devices which satisfy this continuing need.

SUMMARY OF THE INVENTION

The present invention overcomes these and other shortcomings of the prior art by providing a light control eyeglass holder for bedside use. The novel device comprises an eyeglass holder which may have a suitable ornamental appearance, a power inlet to the device, and a power outlet such as an AC socket into which may be plugged a reading lamp, bedside radio, etc. The device of the invention further comprises a night light such as a small neon lamp which is mounted so as to facilitate location and retrieval of the eyeglasses in the dark. A normally closed switch is connected between the power inlet and the power outlet so that AC current from the inlet is normally available at the power outlet for lighting a reading lamp or the like. When a pair of eyeglasses is placed in the holder, the normally closed switch opens, interrupting power to the outlet, thereby extinguishing the lamp or other device plugged into the outlet. A normally open switch is connected between the night lamp and the power inlet, and closes in response to the placement of a pair of eyeglasses in the holder to supply power to the night lamp which remains lit so long as the eyeglasses remain in the holder, to facilitate retrieval of the eyeglasses in the room which has now been darkened by cutting off power to the reading lamp plugged into the power outlet of the device.

When the eyeglasses are removed from the holder, both the normally open and the normally closed switches return to their normal states, again supplying power to a lamp plugged into the power outlet, while extinguishing the night lamp which is then no longer needed.

Preferably, the switches are actuated in response to the weight of the eyeglasses bearing on a movable support provided in the bottom of the holder. The normally closed and normally opened switches may be combined in a single device such as a single pole double throw microswitch disposed underneath the eyeglass support and mechanically connected to the movable support such that the switch is actuated upon depression of the support by the weight of eyeglasses resting thereon.

BRIEF DESCRIPTION OF THE DRAWINGS

FIG. 1 is a perspective view of a combination eyeglass holder night light constructed according to the present invention with the switch actuating rod shown in phantom lining.

FIG. 2 is a perspective view of the device partly broken away to illustrate the internal switch arrangement.

FIG. 3 is a cross-section taken in elevation along line 3—3 in FIG. 2.

FIG. 4 is an electrical schematic diagram of the system.

DETAILED DESCRIPTION OF THE PREFERRED EMBODIMENT

With reference to the drawings and FIGS. 1, 2 and 3 in particular, the combination eyeglass holder light control 10 of the present invention comprises a base housing 12 to which is mounted an eyeglass holder 14. The eyeglass holder has a front wall 16, a rear wall 18, and a bottom 20, which together define a generally U-shaped channel. An elongated rectangular switch bar 22 is disposed within the holder 14 and supported on a pair of posts 40 extending downwardly into the interior of the base housing through aligned openings in the holder bottom 20 and base 12. While the holder bottom 20 is affixed by any suitable means to the base 12, the switch bar 22 and supporting posts 40 are vertically movable relative to both the base and the holder.

A single pole, double throw microswitch 24 provided with an actuating lever 26 is mounted to the base housing 12 by means of a circuit board 28. Any one of numerous commercially available switches may be used as switch 24, for example a subminiature SPDT lever switch with the contacts rated at 5 amperes at 250 VAC. With reference to the diagram of FIG. 4, the normally closed side S2 of switch 24 is connected between an AC inlet 30 and an AC outlet 32. While a separate male plug and a female socket may be used for the inlet 30 and outlet 32, respectively, each connected by its own two conductor AC cord to the switch 24, it is preferable to use a combination plug 35 such as illustrated in FIG. 2, having male prongs on one side for the AC inlet 30, and female socket terminals on another side for the AC outlet 32, the combination plug being connected to the switch 24 by means of a three conductor cord 37 (omitted in FIG. 1 for clarity), one of the conductors of the cord 37 being common to the inlet 30 and outlet 32.

A night light circuit includes neon lamp 34 connected through series current limiting resistor 36 and the normally open side S1 of switch 24 to the power inlet 30, as shown in the schematic diagram of FIG. 4. In the normal condition of the device shown in FIG. 4, power from the inlet 30 is supplied through the normally closed side of switch 24 to the power outlet 32, while the night light circuit is interrupted by the normally open side of switch 24.

A switching rod 38 has a pair of upwardly extending ends 42 fitted into the posts 40 of the switch bar 22, and has a horizontally extending portion 44 connecting the two vertical ends 42 of the switching rod, but laterally offset by parallel horizontal portions 46. The horizontally extending portion 44 further has a hairpin turn 48 formed so as to overly the lever 26 of the switch 24. The horizontal portion 44 is held captive but free for pivotal movement between a pair of posts 50 rising from the bottom 52 of the base housing and a pair of posts 58 extending downwardly from the top 15 of the base 12. A groove is formed in the upper end of each post 50 and in the lower ends of posts 58. The base housing 12 may have a separate bottom 52 to whch are affixed the two posts 50. When the bottom 52 is secured to the base housing 12 as by a snap fit, gluing or other means, the upper ends of the posts 50 abut the lower ends of the posts 58 such that the grooves in the post ends 50, 58 oppose each other and together define bores within which is pivotable the switch rod such that when a weight is placed on the switch bar 22, a downward force is applied through the posts 40 to the ends of arms 46 of the switch rod 38, the force being offset from the horizontal portion 44 which is thus made to pivot bringing the hairpin portion 48 downwardly against the actuating lever 26 of the switch, throwing the switch 24 so that the normally open section of the switch closes while the normally closed section opens. The night light circuit is thus closed, supplying power to the neon lamp 34 while interrupting power to the AC outlet 32.

Desirably, the base housing 12 is molded of an opaque plastic material, while the holder 14 and switch bar 22 may be molded of a translucent plastic. The base may be provided with a light guide portion 54 which extends through an opening in the top of the base 12, and has a concave cylindrical surface 55 adapted to fit against the outer surface of the neon lamp 34 within the base 12. The neon lamp 34 is supported in horizontal position on a support 56 which extends upwardly from the base bottom 52 and is constructed so as to hold the neon lamp captive between the support 56 and the light guide 54 when the device is assembled. The neon lamp is connected to the switch 24 through conductors provided on the circuit board 28. When assembled, the light guide portion 54 of the eyeglass holder 14 fits against the neon lamp 34 and serves as an optical wave guide whereby light emitted by the neon lamp is guided and diffused throughout the eyeglass holder 14, creating a low level diffused glow sufficient for locating the eyeglass holder in the dark, but dim enough so as not to disturb sleep.

The base housing illustrated in the drawings is elliptical in plan view and frustoconical in elevation. However, both the base housing 12 and the eyeglass holder 14 may take shapes other than those shown. It will be further understood that the invention extends to means for sensing the presence of eyeglasses in the holder 14 activated by other than the weight of the eyeglasses, such as, for example, photosensing means activated by light changes on a sensing element caused by placement of eyeglasses thereon.

While a particular embodiment of the invention has been shown and illustrated for purposes of clarity, it will be understood that many changes, substitutions and modifications may be made by those possessed of ordinary skill in the art. The scope of the invention is therefore limited only by the following claims.

What is claimed is:

1. An eyeglass holder for bedside use comprising:
eyeglass holder means;
power inlet and power outlet means;
night light means;
normally closed switch means connecting said power inlet to said power outlet, said normally closed switch means opening in response to the placement of a pair of eyeglasses in said holder means to cut off power to said outlet;
normally open switch means connected between said night lamp and said power inlet means, said normally open switch means closing in response to the placement of a pair of eyeglasses in said holder means to supply power to said light lamp thereby to facilitate retrieval of said eyeglasses;
said normally open and said normally closed switch means returning to their normal states upon removal of said eyeglasses from said holder means.

2. The eyeglass holder of claim 1 wherein said normally open and normally closed switch means are responsive to the weight of eyeglasses placed in said eyeglass holder means.

3. The eyeglass holder of claim 1 wherein said normally closed switch means and normally open switch means are a single pole double throw pressure sensitive switch.

4. The eyeglass holder of claim 3 further comprising support means within said holder means, said support means bearing on said pressure sensitive switch means for transmitting the weight of a pair of eyeglasses placed in said holder means against said switch means thereby to throw said switch means from its normal state.

5. The eyeglass holder of claim 4 further comprising a base housing, said switch means being mounted within said base, said support means bearing on a pivotable switch rod within said base housing, said switch rod acting against said switch means in response to a downward force applied to said support means for throwing said switch means from said normal state.

6. The eyeglass holder of claim 1 wherein said night light means comprises one or more neon lights.

7. The eyeglass holder of claim 1 wherein said holder means is made of a material translucent to light, said holder means being illuminated by said night light to thereby facilitate retrieval of eyeglasses placed in said holder means.

8. The holder means of claim 7 wherein said night light is a neon lamp.

9. The eyeglass holder of claim 8 wherein said holder means includes light guide means in contact with said neon lamp to thereby diffuse the light emitted by said neon lamp through said translucent holder means to create a diffused glow.

10. The eyeglass holder of claim 1 wherein said holder means is a channel structure including a front wall, a rear wall and bottom connecting said front and rear walls.

11. The holder of claim 2 wherein said holder means is a channel structure including a front wall, a rear wall and a bottom connecting said front and rear walls, said support means including an elongated rectangular support member disposed above the bottom of said holder means, said support comprising post means extending through said holder means into said base housing, and switch actuating means connected to said post means and bearing against said switch means responsive to placement of a pair of eyeglasses within said holder means and on said support means to thereby throw said switch means.

* * * * *